US007712453B2

(12) United States Patent
Nonoyama et al.

(10) Patent No.: US 7,712,453 B2
(45) Date of Patent: May 11, 2010

(54) DEPRESSURIZING VALVE AND FUEL INJECTION DEVICE

(75) Inventors: Shigeru Nonoyama, Nishikamo-gun (JP); Naoki Mitsumata, Takahama (JP); Fumiaki Murakami, Okazaki (JP)

(73) Assignee: DENSO CORPORATION, Kariya (JP)

( * ) Notice: Subject to any disclaimer, the term of this patent is extended or adjusted under 35 U.S.C. 154(b) by 29 days.

(21) Appl. No.: 11/546,913

(22) Filed: Oct. 13, 2006

(65) Prior Publication Data

US 2007/0084443 A1 Apr. 19, 2007

(30) Foreign Application Priority Data

Oct. 14, 2005 (JP) ..... 2005-300318
Jul. 6, 2006 (JP) ..... 2006-186665

(51) Int. Cl.
*F02M 59/36* (2006.01)

(52) U.S. Cl. ..... 123/458; 335/282; 251/129.15; 239/585.1

(58) Field of Classification Search ..... 251/129.15–129.22, 30.01; 123/499, 498, 123/456; 335/299, 282; 239/585.1–585.5; *F02M 59/36*
See application file for complete search history.

(56) References Cited

U.S. PATENT DOCUMENTS 3,712,581 A * 1/1973 Parlow ..... 251/129.15
4,588,162 A * 5/1986 Moffat ..... 251/129.16
5,566,921 A * 10/1996 Yokota et al. ..... 251/129.22
6,042,082 A 3/2000 Graner et al.
6,237,570 B1 5/2001 Aoki et al.
6,253,737 B1 * 7/2001 Radue ..... 123/499
6,408,824 B1 6/2002 Pacucci et al.
6,640,787 B2 * 11/2003 Nichogi et al. ..... 123/499
6,659,424 B2 * 12/2003 Buse et al. ..... 251/129.15
6,854,703 B2 * 2/2005 Parker et al. ..... 251/30.01
7,234,706 B2 * 6/2007 Seymour et al. ..... 277/594

(Continued)

FOREIGN PATENT DOCUMENTS

EP 1319827 A2 6/2003

(Continued)

OTHER PUBLICATIONS

European Search Report dated Dec. 19, 2006.

(Continued)

*Primary Examiner*—Stephen K Cronin
*Assistant Examiner*—Keith Coleman
(74) *Attorney, Agent, or Firm*—Nixon & Vanderhye PC

(57) ABSTRACT

An object of the invention is to provide a depressurizing valve mounted to a common rail for a fuel injection device, in which a direction of a connector for the depressurizing valve can be adjusted, without affecting an air gap and a sealing performance. The depressurizing valve has a valve unit and a coil unit which is detachably assembled to the valve unit by a mounting member, such as a retaining nut. A valve housing has an inside space, which is fluid tightly separated into first and second spaces by a connecting member, which is fluid tightly connected to the valve housing and a stator core. A valve body and a spring are arranged in the first space for closing a flow control port. A cylindrical coil is accommodated in the second space, such that the coil is rotatable with respect to the valve housing.

10 Claims, 5 Drawing Sheets

U.S. PATENT DOCUMENTS

| | | | | |
|---|---|---|---|---|
| 2002/0088955 | A1* | 7/2002 | Gamou et al. | 251/30.01 |
| 2002/0096145 | A1 | 7/2002 | Ricco et al. | |
| 2006/0042599 | A1 | 3/2006 | Frank et al. | |
| 2006/0102150 | A1 | 5/2006 | Frank et al. | |

FOREIGN PATENT DOCUMENTS

| | | |
|---|---|---|
| JP | 10-122080 | 5/1998 |
| JP | 10-266923 | 10/1998 |
| JP | A-2001-182638 | 7/2001 |

OTHER PUBLICATIONS

First Office Action dated Dec. 21, 2007 in CN Application No. 200610131835.6 with English translation.

Japanese Office Action dated Jan. 19, 2010, issued in corresponding Japanese Application No. 2006-186665, with English translation.

* cited by examiner

DEPRESSURIZING VALVE AND FUEL INJECTION DEVICE

CROSS-REFERENCE TO RELATED APPLICATION

This application is based on Japanese Patent Application Nos. 2005-300318 filed on Oct. 14, 2005 and 2006-186665 filed on Jul. 6, 2006, disclosures of which are incorporated herein by reference.

FIELD OF THE INVENTION

The present invention relates to a depressurizing valve for decreasing fuel pressure in a common rail of a fuel injection device at a vehicle deceleration, and further relates to a fuel injection device having the depressurizing valve.

BACKGROUND OF THE INVENTION

A conventional fuel injection device for an internal combustion engine has; a common rail for storing a high pressure fuel; fuel injection valves for injecting the high pressure fuel from the common rail into respective cylinders of the engine; a fuel pump for sucking and pressurizing the fuel and supplying the high pressure fuel to the common rail; a fuel return path for returning a portion of the high pressure fuel from the common rail to a low pressure side (a fuel tank); an electromagnetic type depressurizing valve which will be operated to open the fuel return path when the vehicle is decelerated in order to quickly reduce the fuel pressure in the common rail.

The depressurizing valve is mounted to, for example, the common rail. In the fuel injection device, however, as disclosed in Japanese Patent Publication No. 2001-59459, the depressurizing valve is mounted to the fuel pump. The depressurizing valve has a flanged portion, at which a through hole is formed for inserting a bolt therethrough, and the depressurizing valve is fixed to the fuel pump by the bolt.

In the fuel injection device, as disclosed in Japanese Patent Publication No. H11-141428, a solenoid portion is fixed to a body member of a fuel injection valve by a retaining nut, wherein an electromagnetic valve portion thereof can be used as a depressurizing valve.

The depressurizing valve mounted to the common rail has a connector for receiving driving current. The connector is electrically connected to a driving circuit through a wire harness, when the common rail is mounted to the engine. It is, however, necessary to adjust a direction of the connector when the depressurizing valve is mounted to the common rail, because the common rail must be mounted to the engine in a limited space and thereby a position (direction) of the connector must be selected to a predetermined position (direction) with respect to the common rail. Nothing has been proposed so far, wherein a direction of the connector is adjusted in the depressurizing valve to be mounted to the common rail.

If the fixing structure of the depressurizing valve, as disclosed in the above mentioned prior art (No. 2001-59459), in which the flanged portion of the valve is fixed to the fuel pump by the bolt, was intended to be applied to a fixing structure for a depressurizing valve to be mounted to the common rail, a bolt hole should be formed in the common rail of a cylindrical shape. In such a fixing structure, the direction of the connector provided in the depressurizing valve can be adjusted to a predetermined desired direction. However, it is actually difficult to form the bolt hole in the common rail, because the common rail is generally formed as the cylindrical shape, and thereby there is no sufficient space for the bolt hole.

In the fuel injection device disclosed in Japanese Patent Publication No. H11-141428, a direction of a connector portion can be adjusted by loosening a retaining nut. However, if the retaining nut was loosened, positions of inside parts, such as a spacer for adjusting an air gap, an armature, and so on would be changed. As a result, there would be a problem that the air gap would be changed after the retaining nut was once loosened and then tightly screwed again. Furthermore, if the retaining nut was loosened, a position and a contacting condition of a sealing member which is disposed between the retaining nut and the valve housing would be also changed. Accordingly, it would be necessary to check a sealing performance once again after the retaining nut was tightly screwed again.

In the case that the structure of the above prior art (Japanese Patent Publication No. H11-141428) for fixing the solenoid portion of the electromagnetic coil to the valve housing was applied to the depressurizing valve to be mounted to the common rail, the direction of the connector portion can be adjusted by loosening the retaining nut. However, there are still problems in that the air gap might be changed and/or the sealing performance should be checked again, as in the fuel injection device of the above mentioned prior art.

SUMMARY OF THE INVENTION

The present invention is made in view of the above problems. An object of the present invention is, therefore, to provide a fuel injection device, more particularly a depressurizing valve mounted to a common rail for the fuel injection device, in which a direction of a connector for the depressurizing valve can be adjusted, without affecting an air gap and a sealing performance.

According to a feature of the present invention, a depressurizing valve is composed of a valve unit having a valve body; and a coil unit for attracting the valve body in a valve opening direction when electric current is supplied to a cylindrical electromagnetic coil.

The valve unit has a valve housing of a cylindrical shape to be mounted to a common rail; an armature integrally formed with the valve body; a first space formed in the valve housing and connected to a fuel return path for accommodating the valve body and the armature; and a second space formed in the valve housing for accommodating the electromagnetic coil, such that the electromagnetic coil is rotatable with respect to the valve housing in a circumferential direction, and the second space is coaxially formed with the first space. The valve unit further has a stator core arranged in an inner peripheral space of the electromagnetic coil and axially opposing to the armature; a connecting member fluid tightly connected to the valve housing and to the stator core, for dividing, together with the stator core, an inside space of the valve housing into the first and second spaces; and a valve seat provided at one end of the first space and having a flow control port for operatively communicating the first space with a high pressure chamber of the common rail by an axial movement of the valve body, wherein the valve body and the armature are axially and movably held in the first space between the valve seat and the stator core.

The coil unit is detachably assembled to the valve unit and has a connector integrally formed with the electromagnetic coil; and a mounting member for detachably mounting the electromagnetic coil and the connector to the valve unit.

According to the above feature, the direction of the connector integrally formed with the electromagnetic coil can be adjusted, since the electromagnetic coil is accommodated in the second space, such that the electromagnetic coil is rotatable with respect to the valve housing in a circumferential direction.

Furthermore, an air gap formed between the armature and the stator core is not changed, even when the mounting member is loosened and tightened for the purpose of adjusting the direction of the connector. This is because the valve body and the armature is held between the valve seat and the stator core.

In addition, a sealing member (such as an O-ring) is not necessary between the first and second spaces, since the first space for accommodating the valve body and the armature is fluid tightly connected to the second space for accommodating the coil by the connecting member. As a result, it is not necessary to check the sealing performance again after the mounting member is loosened and tightened.

According to another feature of the present invention, the connecting member is made of a non-magnetic material. Due to the non-magnetic material, the magnetic flux is blocked between the valve housing and the stator core, so that the valve body and the armature can be surely attracted.

According to a further feature of the present invention, a depressurizing valve is composed of a valve unit having a valve body; and a coil unit for attracting the valve body in a valve opening direction when electric current is supplied to a cylindrical electromagnetic coil.

The valve unit has a valve housing of a cylindrical shape to be mounted to a common rail; an armature integrally formed with the valve body; a first space formed in the valve housing and connected to a fuel return path for accommodating the valve body and the armature; and a second space formed in the valve housing for accommodating the electromagnetic coil, such that the electromagnetic coil is rotatable with respect to the valve housing in a circumferential direction, and the second space is coaxially formed with the first space.

The valve unit further has a stator core arranged in an inner peripheral space of the electromagnetic coil and axially opposing to the armature; a connecting member integrally formed with one of the valve housing and the stator core, for fluid tightly dividing, together with the stator core, an inside space of the valve housing into the first and second spaces, wherein the connecting member restricts magnetic flux flow between the stator core and the valve housing; and a valve seat provided at one end of the first space and having a flow control port for operatively communicating the first space with a high pressure chamber of the common rail by an axial movement of the valve body, wherein the valve body and the armature are axially and movably held in the first space between the valve seat and the stator core.

The coil unit is detachably assembled to the valve unit and has a connector integrally formed with the electromagnetic coil; and a mounting member for detachably mounting the electromagnetic coil and the connector to the valve unit.

According to the above feature, the direction of the connector integrally formed with the electromagnetic coil can be adjusted, an air gap formed between the armature and the stator core is not changed, and it is not necessary to check the sealing performance again after the mounting member is loosened and tightened again.

Furthermore, the number of connecting portions can be reduced, because the connecting member is integrally formed with one of the valve housing and the stator core.

According to a still further feature of the present invention, a depressurizing valve is composed of a valve unit having a valve body; and a coil unit for attracting the valve body in a valve opening direction when electric current is supplied to a cylindrical electromagnetic coil.

The valve unit has a valve housing of a cylindrical shape to be mounted to a common rail; an armature integrally formed with the valve body; a first space formed in the valve housing and connected to a fuel return path for accommodating the valve body and the armature; and a second space formed in the valve housing for accommodating the electromagnetic coil, such that the electromagnetic coil is rotatable with respect to the valve housing in a circumferential direction, and the second space is coaxially formed with the first space.

The valve unit further has a stator core arranged in an inner peripheral space of the electromagnetic coil and axially opposing to the armature; a connecting member integrally formed with and arranged between the valve housing and the stator core, wherein the connecting member and the stator core divide an inside space of the valve housing into the first and second spaces, and wherein the connecting member restricts magnetic flux flow between the stator core and the valve housing; and a valve seat provided at one end of the first space and having a flow control port for operatively communicating the first space with a high pressure chamber of the common rail by an axial movement of the valve body, wherein the valve body and the armature are axially and movably held in the first space between the valve seat and the stator core.

The coil unit is detachably assembled to the valve unit and has a connector integrally formed with the electromagnetic coil; and a mounting member for detachably mounting the electromagnetic coil and the connector to the valve unit.

According to the above feature, the direction of the connector integrally formed with the electromagnetic coil can be likewise adjusted, an air gap formed between the armature and the stator core is not changed, and it is not necessary to check the sealing performance again after the mounting member is loosened and tightened again.

Furthermore, the first and second spaces can be fluid tightly separated without any connecting process, such as, the welding, soldering and the like, since the valve housing, the stator core and the connecting member are integrally formed as one unit.

According to an additional feature of the present invention, a recessed portion is formed in the stator core and opening to the first space, and a spring is arranged in the recessed portion for biasing the valve body in the valve closing direction.

According to such a feature, the spring is not dropped out from the valve unit, even when the coil unit is detached from the valve unit.

According to a further feature of the present invention, the coil unit has a plate member made of a magnetic material, which is arranged between the electromagnetic coil and the connector, and which is integrally molded with the connector.

As a result, any sealing member is not necessary for preventing water from entering into the electromagnetic coil, because the electromagnetic coil and the connector are integrally molded.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
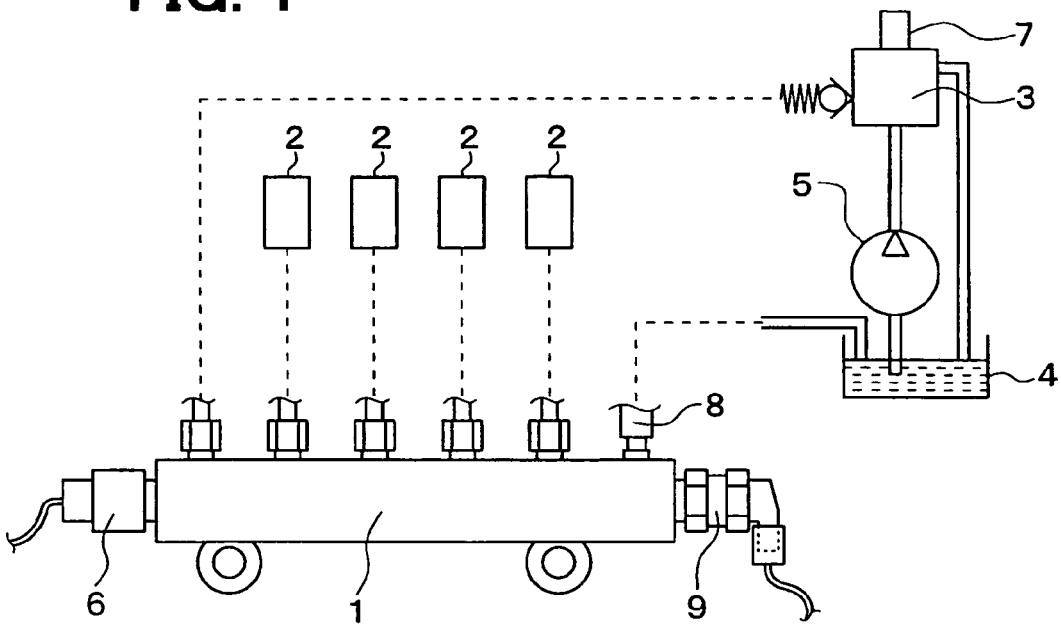
FIG. 1 is a schematic diagram showing a system structure of a common rail type fuel injection device having a depressurizing valve.

A first embodiment of the present invention will be disclosed. FIG. 1 is a schematic diagram showing a system structure of a common rail type fuel injection device having a depressurizing valve according to the first embodiment. The fuel injection device has a common rail 1, which is formed into almost a cylindrical shape and in which a high-pressure fuel is stored. Multiple fuel injection valves 2 are connected to the common rail 1, wherein the fuel injection valves 2 are mounted to respective engine cylinders of a diesel engine (not shown) so that the high pressure fuel stored in the common rail 1 is injected into the engine cylinders through the respective fuel injection valves 2. A valve opening timing as well as a valve opening period for the respective fuel injection valves 2 is controlled by an electronic control unit (ECU) which is not shown in the drawing.

The ECU comprises a well known microcomputer having CPU, ROM, RAM and so on, and carries out various kinds of calculations and processes which are memorized in the microcomputer. The ECU controls respective operations of the fuel injection valves 2, a fuel amount control valve 7, a depressurizing valve 9, and so on, upon receiving information, such as an engine rotational speed, a pedal stroke of an acceleration pedal (not shown), and so on.

The high pressure fuel is supplied from a fuel pump 3 to the common rail 1, and the high pressure fuel is stored in a high pressure chamber 1*e* of the common rail 1 at such a pressure corresponding to a fuel injection pressure. A well known fuel pump of a variable capacitor type is used as the fuel pump 3. The fuel is fed by a feed pump 5 from a fuel tank 4 to the fuel pump 3, and the fuel is pressurized by the fuel pump 3. The ECU receives a pressure signal from a pressure sensor 6 provided at the common rail 1, and controls the fuel amount control valve 7 provided to the fuel pump 3, such that the fuel injection pressure is adjusted at a predetermined value determined by an engine load and an engine rotational speed.

The common rail 1 is connected to the fuel tank 4 through a leak pipe 8, which forms a fuel return path. The depressurizing valve 9 is attached at one longitudinal end of the common rail 1, for opening and closing the fuel return path. The ECU controls the depressurizing valve 9 in accordance with the engine operational condition, such that the fuel pressure in the common rail 1 is adjusted at (reduced to) a target value by opening the depressurizing valve 9 to return a portion of the high pressure fuel from the common rail 1 to the fuel tank 4 through the fuel return path.

Figure 2:
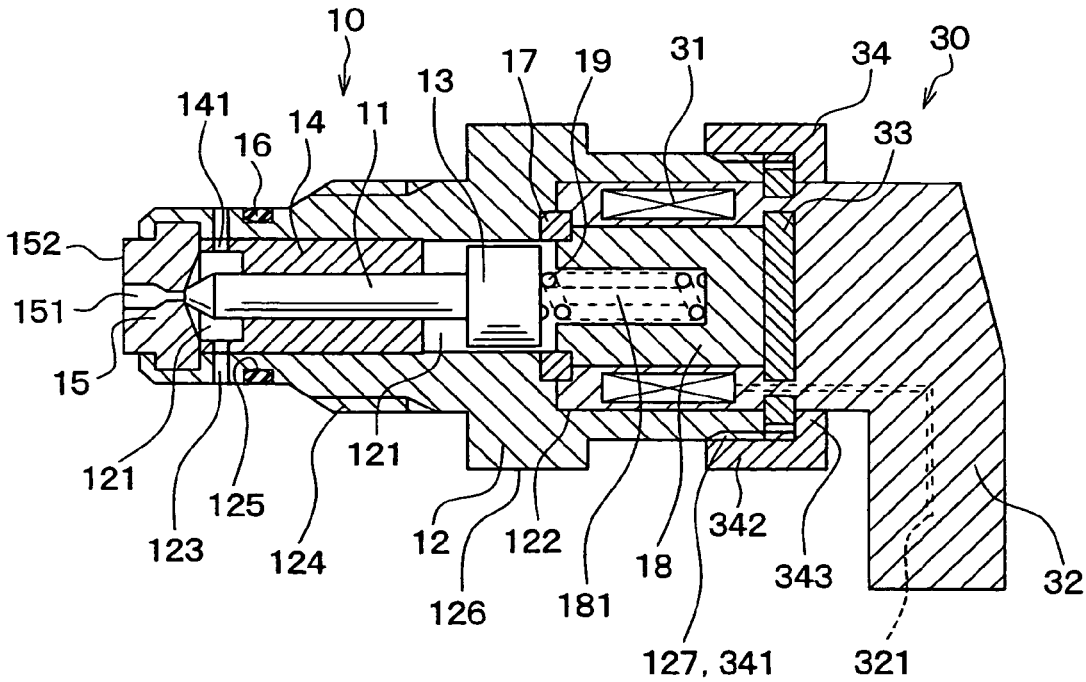
FIG. 2 is a cross sectional view showing the depressurizing valve 9 in FIG. 1.
Figure 3:
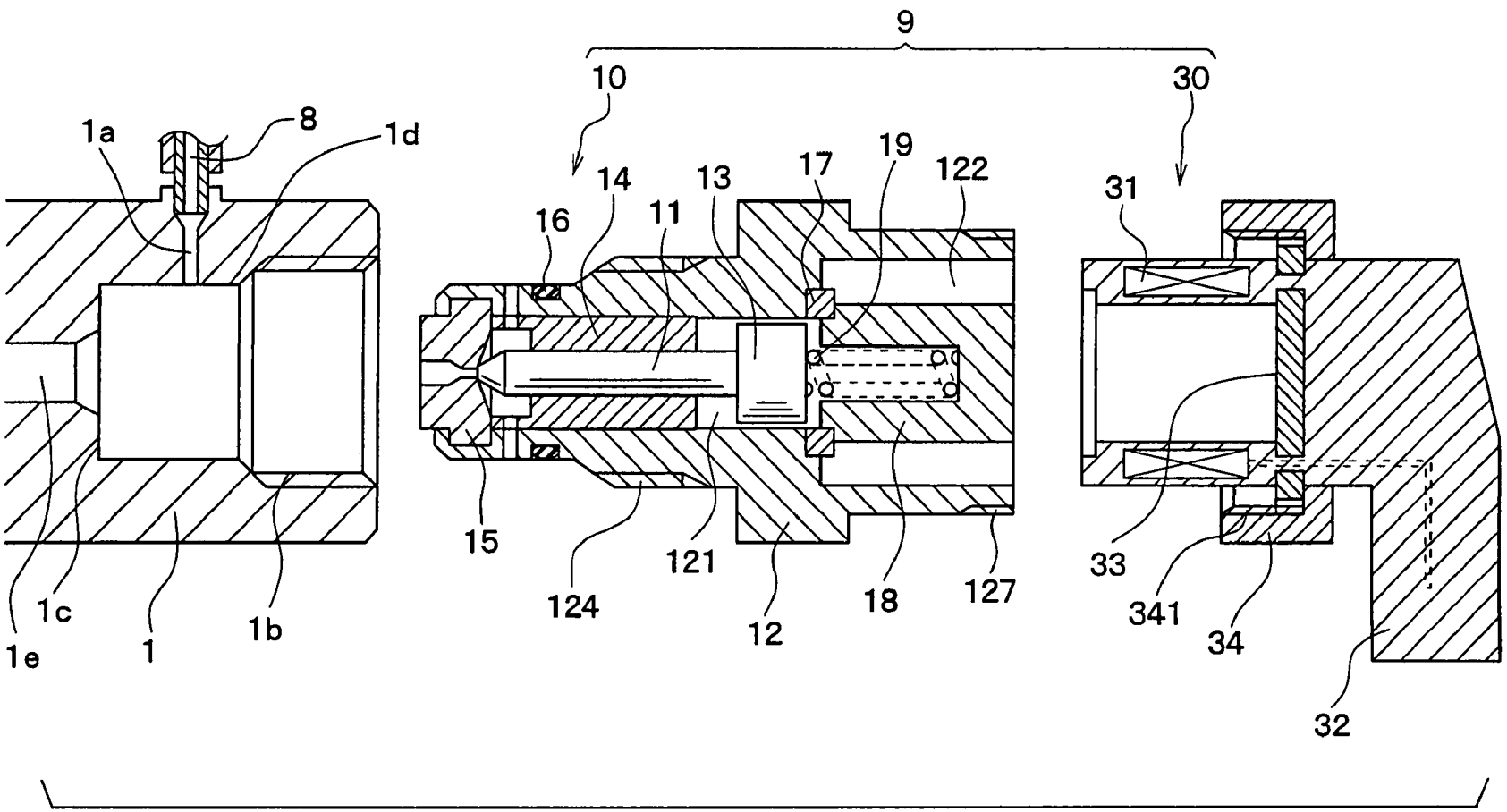
FIG. 3 is an exploded cross sectional view of the depressurizing valve 9.
Figure 4:
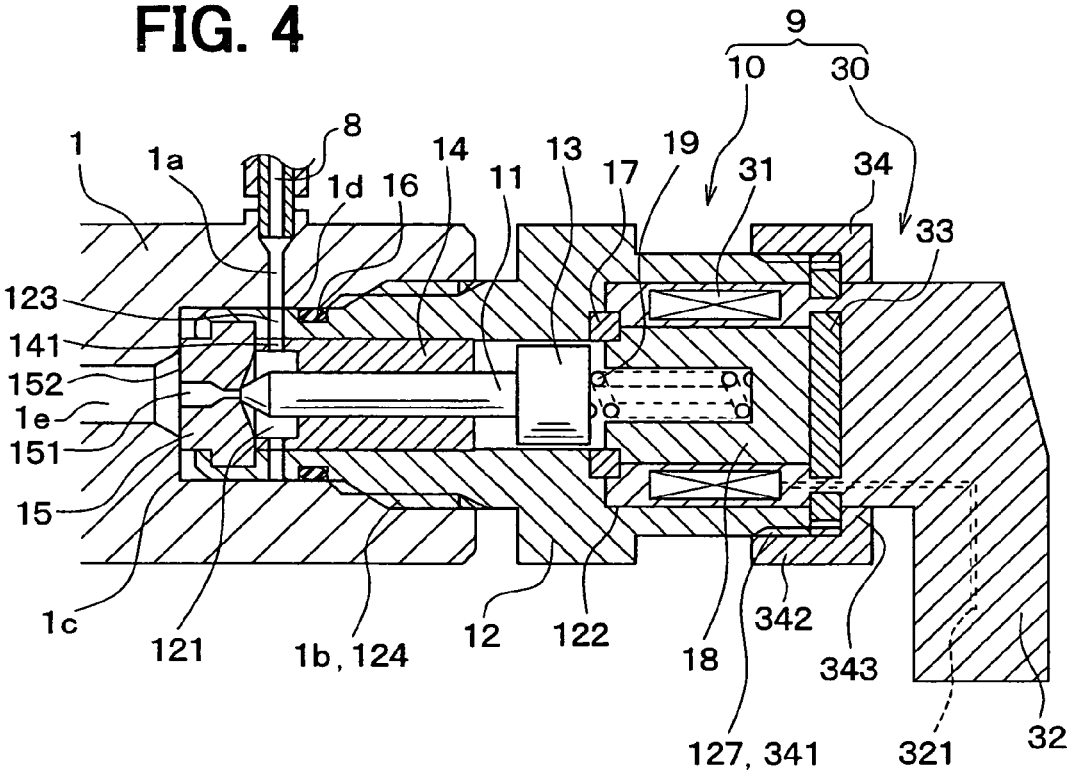
FIG. 4 is a cross sectional view showing the depressurizing valve 9 mounted to a common rail 1.

The depressurizing valve 9 will be further explained with reference to FIGS. 2 to 4. FIG. 2 shows a cross sectional view of the depressurizing valve 9, FIG. 3 shows an exploded view thereof, and FIG. 4 shows the depressurizing valve 9 mounted to the common rail 1.

The depressurizing valve 9 is composed of a valve unit 10 and a coil unit 30, wherein the coil unit 30 is detachably assembled to the valve unit 10. The valve unit 10 has a valve body 11 for opening and closing the fuel return path, whereas the coil unit 30 has a cylindrical coil 31 of an electromagnetic type for attracting the valve body 11 in a valve opening direction when the coil 31 is energized.

The valve unit 10 has a cylindrical valve housing 12 made of a magnetic metal and screwed into the common rail 1. A first cylindrical space 121 and a second cylindrical space 122 are formed in the inside of the valve housing 12, which are longitudinally connected to each other. The valve body 11 and an armature 13 are accommodated in the first cylindrical space 121. The coil 31 of the coil unit 30 is accommodated in the second cylindrical space 122, such that the coil 31 can rotate in a circumferential direction.

A cylindrical guide member 14 is press fitted into the first cylindrical space 121 for slidably supporting the valve body 11. The armature is made of a magnetic metal and fixed to the valve body 11 by a press fit or a welding.

A valve seat 15 is fixed to one end of the valve housing 12 by the press-fit or caulking. The first cylindrical space 121 is operatively communicated with the inside of the common rail 1 through a flow control port 151 formed in the valve seat 15. The first cylindrical space 121 is further communicated with a fuel return port 1*a* formed in the common rail 1 through a communication port 141 formed in the guide member 14 and a communication port 123 formed in the valve housing 12. The fuel return port 1*a* is connected to the leak pipe 8.

A first male screw portion 124 is formed at an outer peripheral surface of the valve housing 12, such that the male screw portion 124 will be screwed into a female screw portion 1*b* formed in the common rail 1. An annular groove 125 is also formed at the outer peripheral surface of the valve housing 12 between the first male screw portion 124 and the communication port 123, for accommodating a sealing member 16, such as an O-ring. A hexagon head portion 126 is further formed at a middle portion of the valve housing 12, wherein the hexagon head portion 126 is positioned at an outside of the common rail 1 when the valve housing 12 is mounted (screwed) to the common rail 1. A second male screw portion 127 is formed at a rear end of the valve housing 12, which will be engaged with (screwed into) a retaining nut 34 (also referred to as a mounting member).

An annular connecting member 17, made of a non-magnetic metal, is arranged a boundary portion between the first and second spaces 121 and 122. A stator core 18 made of a magnetic metal is arranged in the second space 122, such that the stator core 18 opposes to the armature 13. The connecting member 17 is fluid-tightly fixed to the valve housing 12 and to the stator core 18 by welding, soldering and the like. The first and second spaces 121 and 122 are thus fluid-tightly separated by the connecting member 17 and the stator core 18.

A recessed portion 181 opening to the first space 121 is formed in the stator core 18. A spring 19 is arranged in the recessed portion 181, so that the valve body 11 and the armature 13 are biased by the spring 19 in a direction toward the valve seat 15, namely a valve closing direction.

The valve seat 15 is press-fitted into or fixed by caulking to the open end (the end of the left-hand side) of the valve housing 12, after the valve body 11, the armature 13, the guide member 14 and the spring 19 are inserted into the first space 121. As above, the valve body 11, the armature 13, and the spring 19 are held in the first space 121 between the valve seat 15 and the stator core 18.

The coil unit 30 is composed of the coil 31, a connector 32, a plate 33, and the retaining nut 34, wherein the coil 31, the plate 33 and a terminal 321 are integrally molded in the connector 32. The plate 33 is arranged at a right-hand side of the coil 31, and an outer peripheral portion of the plate 33 is projecting outwardly from the connector 32. The terminal 321 is connected at its one end to the coil 31.

The coil 31 is formed into a cylindrical shape. The coil 31 is accommodated in the cylindrical space formed by the valve housing 12, the stator core 18 and the connecting member 17, such that the coil 31 is rotatable in its circumferential direction. In other words, a circumferential position of the coil 31 with respect to the valve housing 12 can be freely selected. Accordingly, a direction of the terminal 321 of the connector 32 can be selectively decided.

The plate 33 is made of a magnetic metal and formed into a circular disc shape. The plate 33 is arranged to oppose to the valve housing 12 and the stator core 18, to form a magnetic circuit together with the valve housing 12 and the stator core 18.

The retaining nut (fixing means) 34 is composed of a cylindrical portion 342 and a flanged portion 343 inwardly extending from one longitudinal end of the cylindrical portion 342. A female screw portion 341 is formed at an inner peripheral surface of the cylindrical portion 342, such that the female screw portion 341 will be engaged with the second screw portion 127 formed at the valve housing 12. The retaining nut 34 is assembled to the connector 32 after the coil 31 and the plate 33 are integrally molded in the connector 32, such that an inner end of the flanged portion 343 holds the outer peripheral portion of the plate 33, wherein the retaining nut 34 can be rotatable with respect to the connector 32.

A process for assembling the depressurizing valve 9 to the common rail 1 will be explained. The coil unit 30 is at first tentatively assembled to the valve unit 10. Namely, the coil 31 is inserted into the cylindrical second space 122, and the retainer 34 is screwed onto the second screw portion 127 until the outer peripheral portion of the plate 33 is interposed between and held by the longitudinal end of the valve housing 12 and the flanged portion 343 of the retaining nut 34.

Then, the male screw portion 124 of the valve housing 12 is screwed into the female screw portion 1*b* of the common rail 1, to firmly fix the depressurizing valve 9 (more specifically, the valve housing 12) to the common rail 1. In this screwed position of the valve housing 12, a front surface 152 of the valve seat 15 is brought into contact with and pressed against a seal surface 1*c* of the common rail 1, so that a space between the front surface 152 and the seal surface 1*c* is sealed. Further, the sealing member 16 is in contact with an inner peripheral sealing surface 1*d* of the common rail 1, to prevent the fuel from leaking through a gap between the valve housing 12 and the common rail 1

Then, the retaining nut 34 is loosened from the valve housing 12 in order that the direction of the connector 32 is adjusted with respect to the common rail 1. Thereafter, the retaining nut 34 is tightly screwed again to the valve housing 12, to finish the process of assembling the depressurizing valve 9 to the common rail 1.

In the above embodiment, the coil unit 30 is tentatively assembled to the valve unit 10, and then the valve unit 10 is assembled to the common rail 1 together with the coil unit 30. However, the valve unit 10 can be at first assembled to the common rail 1 without a tentative assembling of the coil unit 30. In this case, the coil unit 30 will be firmly assembled to the valve unit 10, after the valve unit 10 has been assembled to the common rail 1.

In the above common rail type fuel injection device, electrical current supply to the coil 31 of the depressurizing valve 9 is cut off in the operational conditions of the vehicle other than a vehicle decelerating operation. Therefore, the valve body 11 and the armature 13 are biased by the spring toward the valve seat 15, such that the valve body 11 is in contact with the valve seat 15 to close the flow control port 151. As a result, the fuel return path is closed.

In the case that a pedal stroke of the acceleration pedal is rapidly decreased, namely in the deceleration of the vehicle, the ECU opens the depressurizing valve 9, so that a portion of the high pressure fuel in the common rail 1 is drained to the fuel tank 4. As a result, the fuel pressure in the common rail 1 is quickly decreased to a target pressure.

More exactly, when the electrical current is supplied to the coil 31 through the terminal 321 of the connector 32, the magnetic flux is generated around the coil 31 to produce an attracting force between the stator core 18 and the armature 13. Then, the armature 13 as well as the valve body 11 is displaced toward the stator core 18 against the spring force of the spring 19. The valve body 11 is separated from the valve seat 15 to open the flow control port 151 of the valve seat. As a result, the high pressure fuel in the common rail 1 flows to the fuel tank 4 through the flow control port 151 of the valve seat 15, the communication port 141 of the guiding member 14, the communication port 123 of the valve housing 12, the fuel return port 1*a* of the common rail 1, and the leak pipe 8.

In the above embodiment, the coil 31 is inserted into the second space 122 of the valve housing 12 such that the coil 31 is rotatable therein with respect to the valve housing 12. Accordingly, the direction of the connector 32 integrally formed with the coil 31 can be adjusted.

Furthermore, in the above embodiment, the valve body 11 and the armature 13 are held by and between the valve seat 15 and the stator core 18. Accordingly, even when the retaining nut 34 is loosened to adjust the direction of the connector 32, an air gap between the armature 13 and the stator core 18 is not changed.

Furthermore, since the valve body 11, the armature 13 and the spring 19 are held by and between the stator core 18 and the valve seat 15, those parts 11, 13 and 19 may not be detached from the valve housing 12, even when the coil unit 30 is disassembled from the valve unit 10.

In addition, in the above embodiment, the first space 121 for the valve body 11 and the armature 13, and the second space 122 for the coil 31 are fluid tightly sealed from each other by the connecting member 17 and the stator core 18. Therefore, no additional sealing element (such as an O-ring) is necessary between the first and second spaces 121 and 122. Furthermore, it is not necessary to check a seal performance after the retaining nut 34 is loosened and then screwed again.

The coil 31 is integrally molded in the connector 32, it is not necessary to provide any sealing means for preventing water from entering into the coil.

Second Embodiment

Figure 5:
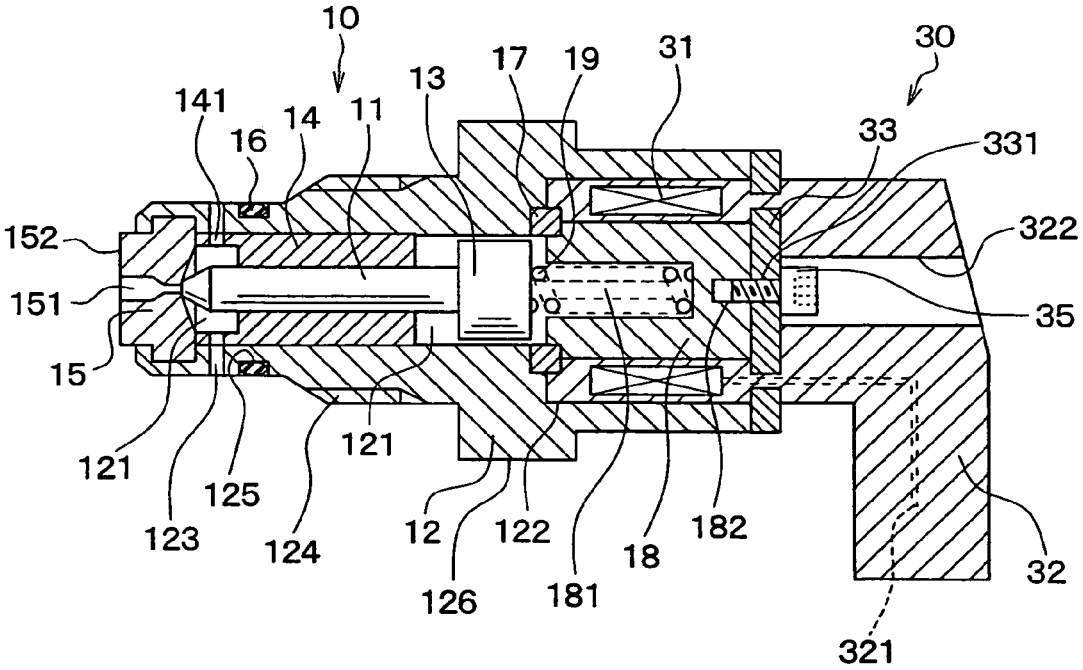
FIG. 5 is a cross sectional view showing a depressurizing valve according to a second embodiment.

A second embodiment of the present invention will be explained. FIG. 5 shows a cross sectional view of the depressurizing valve according to the second embodiment. The same reference numerals are given to the same or similar parts to the first embodiment.

In the above first embodiment, the coil unit 30 is assembled to the valve unit 10 by the retaining nut 34, wherein the female screw portion 341 of the retaining nut 34 is screwed with the male screw portion 127 of the valve housing 12. The second embodiment differs from the first embodiment in the assembling method of the coil unit 30 to the valve unit 10.

As shown in FIG. 5, a bolt 35 is used as a fixing means. More exactly, a female screw portion 182 is formed at the stator core 18, a through hole 322 is formed in the connector 32 for inserting the bolt 35, and a through hole 331 is formed in the plate 33 for also inserting a screwed portion of the bolt 35. The bolt 35 can be formed as a hexagon head bolt, a bolt with a head having a hexagon recess, and so on.

The bolt 35 is screwed into the screw portion 182 to firmly hold the plate 33 between the stator core 18 and the head of the bolt 35, so that the coil unit 30 is assembled to the valve unit 10.

Third Embodiment

Figure 6:
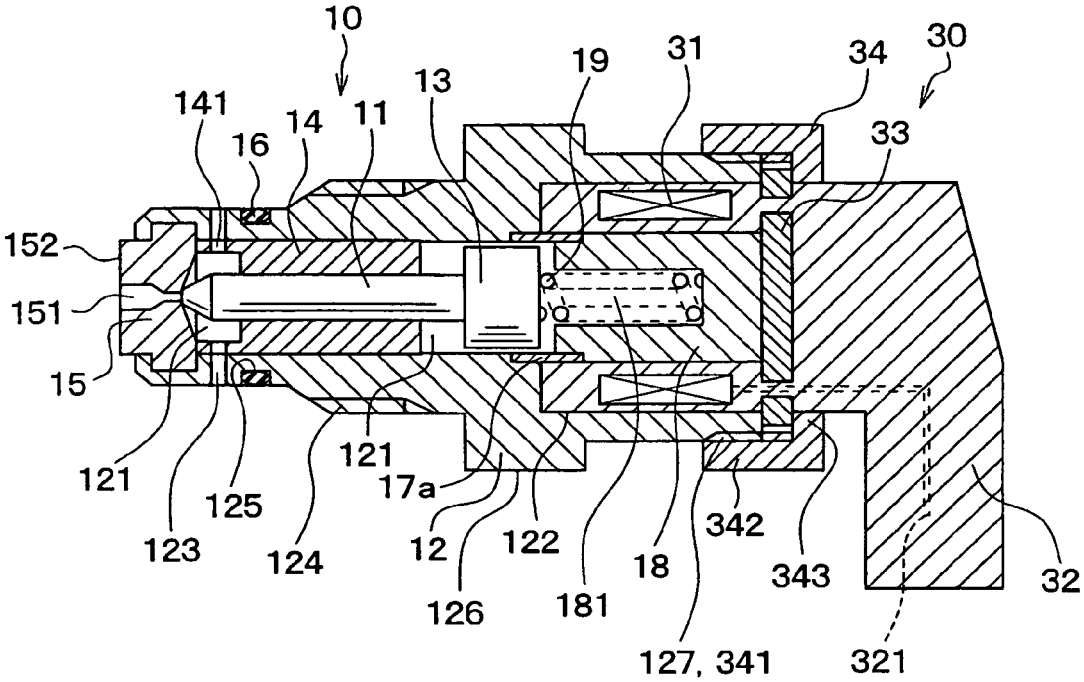
FIG. 6 is a cross sectional view showing a depressurizing valve according to a third embodiment.

A third embodiment of the present invention will be explained. FIG. 6 shows a cross sectional view of the depressurizing valve according to the third embodiment. The same reference numerals are given to the same or similar parts to the first embodiment.

In the first embodiment, the ring-shaped connecting member 17 is used for connecting the valve body 11 to the stator core 18. According to the third embodiment, a pipe-shaped connecting member 17*a* having a thin wall is used.

If the connecting member 17 was made of the magnetic material in the first embodiment, the magnetic flux may not flow from the stator core 18 to the armature 13, but flows from the stator core 18 to the valve housing 12 through the connecting member 17. Then, the attracting force is not generated at the armature 13. This is because the connecting member 17 must be made of the non-magnetic material in the first embodiment.

On the other hand, the connecting member 17*a* of the third embodiment is made of the magnetic material. As shown in FIG. 6, the connecting member 17*a* is formed into the pipe shape having a small thickness to make the flux flow area at a smaller amount, so that the magnetic flux flow is restricted between the stator core 18 and the valve housing 12. As above, even when the magnetic material is used for the connecting member 17*a*, the amount of the magnetic flux flowing through the connecting member 17*a* can be maintained at a smaller value, and the magnetic flux flows from the stator core 18 to the armature 13 to generate the attracting force.

As an alternative method for restricting the magnetic flux flow between the stator core 18 and the valve housing 12, the connecting member 17 in the first embodiment as well as the connecting member 17*a* of the third embodiment is made of a stainless material having the magnetism, and the connecting member 17 or 17*a* is non-magnetized by a partial heat treatment or the like.

Fourth Embodiment

Figure 7:
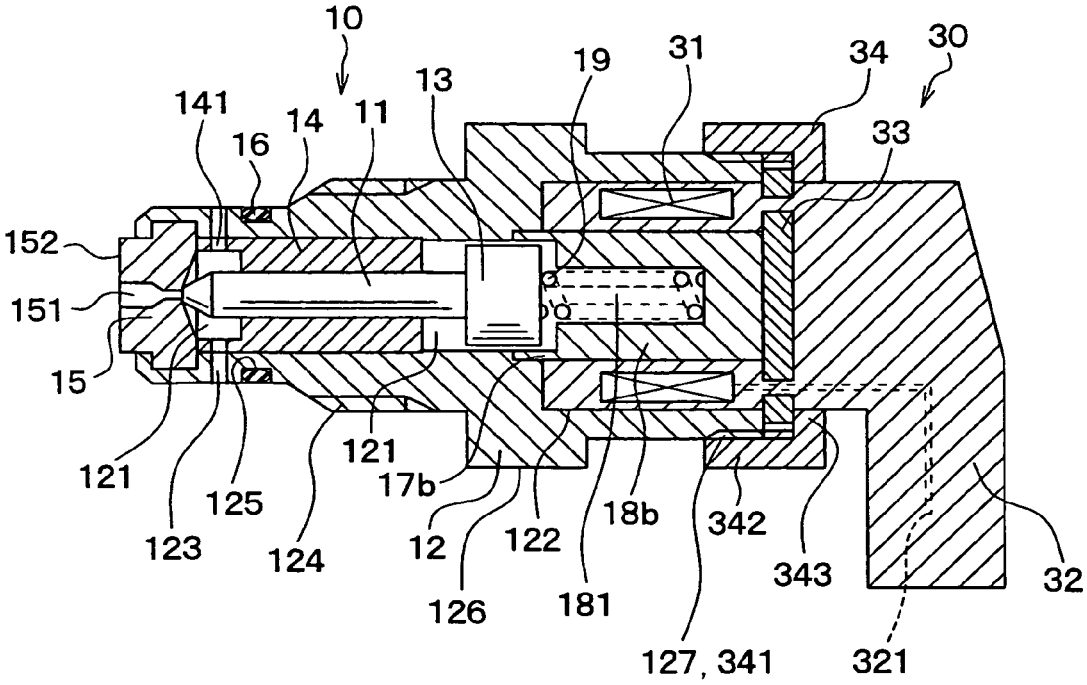
FIG. 7 is a cross sectional view showing a depressurizing valve according to a fourth embodiment.

A fourth embodiment of the present invention will be explained. FIG. 7 shows a cross sectional view of the depressurizing valve according to the fourth embodiment. The same reference numerals are given to the same or similar parts to the first embodiment.

As shown in FIG. 7, a connecting portion 17*b* of a thin wall is integrally formed with the stator core 18*b* made of the magnetic material. The connecting portion 17*b* is fluid tightly connected to the valve housing 12 by the welding, soldering or the like.

In the first to third embodiments, the connecting member 17 or 17*a* is connected to the valve housing 12 and to the stator core 18 by the welding, soldering and the like, namely at two boundaries between the connecting member 17 (17*a*) and the valve housing 12 and between the connecting member 17 (17*a*) and the stator core 18. According to the fourth embodiment, however, the connecting portion 17*b* is connected at one boundary between the connecting portion 17*b* and the valve housing 12, so that the number of process for the welding, soldering and the like can be reduced.

Alternatively, a cylindrical connecting portion of a thin wall may be integrally formed with the valve housing 12 made of the magnetic material, and the thin-walled connecting portion may be fluid tightly connected to the stator core 18 by the welding, soldering and the like.

Fifth Embodiment

Figure 8:
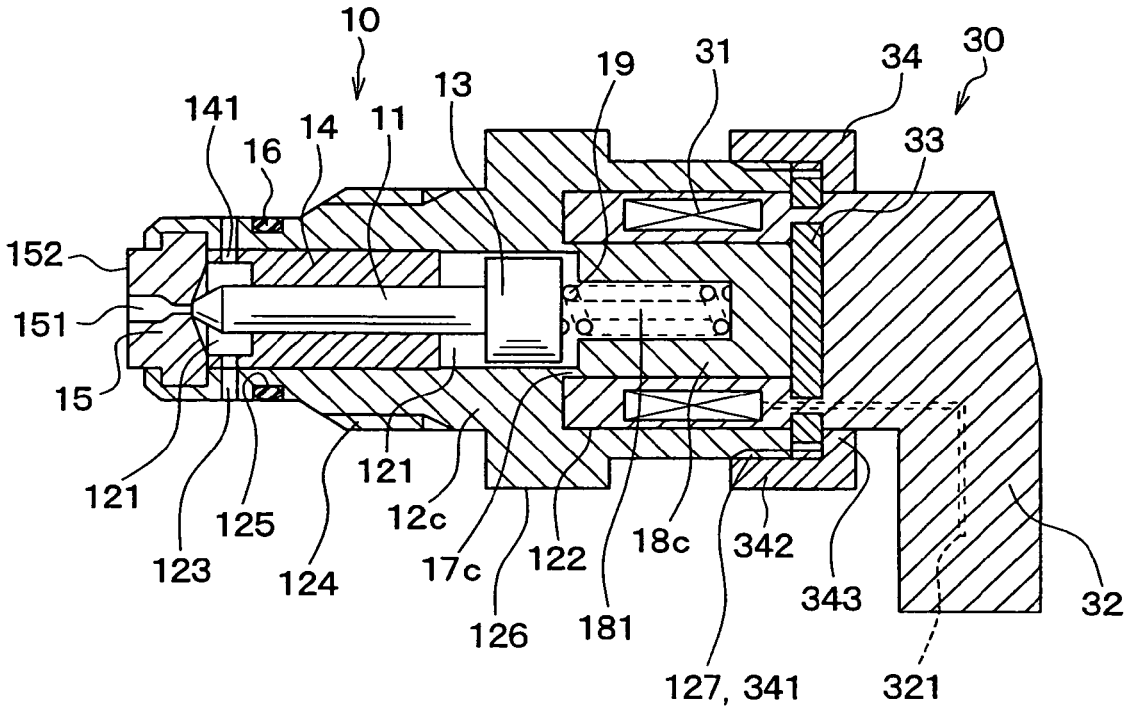
FIG. 8 is a cross sectional view showing a depressurizing valve according to a fifth embodiment.

A fifth embodiment of the present invention will be explained. FIG. 8 shows a cross sectional view of the depressurizing valve according to the fifth embodiment. The same reference numerals are given to the same or similar parts to the first embodiment.

As shown in FIG. 8, a valve housing 12*c* and a stator core 18*c* is integrally formed into a unitary body made of the magnetic material, wherein the stator core 18*c* and the valve housing 12*c* are connected via a thin walled connecting portion 17*c*. According to this embodiment, the first and second spaces 121 and 122 can be fluid tightly separated from each other without the connecting process by the welding, soldering or the like.

What is claimed is:

1. A fuel injection device for an internal combustion engine comprising:

a common rail for storing high pressure fuel;

a fuel injection valve for injecting the high pressure fuel of the common rail into the engine;

a fuel return path operatively connected between the common rail and a low pressure side; and a depressurizing valve for opening and closing the fuel return path so that a part of the high pressure fuel flows from the common rail to the low pressure side when the fuel return path is opened by the depressurizing valve, wherein the depressurizing valve comprises;

a valve unit having a valve body for opening and closing the fuel return path; and a coil unit having a cylindrical electromagnetic coil for attracting the valve body in a valve opening direction when electric current is supplied to the electromagnetic coil, wherein the valve unit further comprises;

a valve housing of a cylindrical shape, which is firmly fixed to the common rail;

an armature integrally formed with the valve body;

a first space formed in the valve housing for accommodating the valve body and armature, and connected to the fuel return path;

a second space formed in the valve housing for accommodating the electromagnetic coil, such that the electromagnetic coil is rotatable with respect to the valve housing in a circumferential direction, the second space being formed coaxially with the first space;

a stator core arranged in an inner peripheral space of the electromagnetic coil and axially opposing to the armature;

a connecting member fluid tightly connected to the valve housing and to the stator core, for dividing, together with the stator core, an inside space of the valve housing into the first and second spaces; and a valve seat provided at one end of the first space and having a flow control port for operatively communicating the first space with a high pressure chamber of the common rail by an axial movement of the valve body, wherein the valve body and the armature are axially and movably held in the first space between the valve seat and the stator core; and wherein the coil unit is detachably assembled to the valve unit and further comprises;

a connector integrally formed with the electromagnetic coil;

a plate member, which is made of a magnetic material, arranged between the electromagnetic coil and the connector, and integrally molded with the connector;

a terminal integrally molded in the connector and electrically connected to the electromagnetic coil;

a through-hole formed in the plate member, through which the terminal passes; and a mounting member selectively screwed to the valve unit for detachably mounting the electromagnetic coil and the connector to the valve unit, wherein the coil unit is rotatable relative to the mounting member, so that when the mounting member is loosened from a firmly fixed position thereof, the coil unit can be rotated with respect to the mounting member so that a circumferential position of the connector with respect to the mounting member can be adjusted, wherein the mounting member has a cylindrical portion and a flanged portion inwardly extending from one longitudinal end of the cylindrical portion, a female screw portion is formed at an inner peripheral surface of the cylindrical portion so that the mounting member is selectively screwed to the valve unit, and the flanged portion holds an outer peripheral portion of the plate member when the mounting member is screwed to the valve unit.

2. A fuel injection device according to claim 1, wherein the connecting member is made of a non-magnetic material.

3. A fuel injection device according to claim 1, wherein a recessed portion is formed in the stator core and opening to the first space, and a spring is arranged in the recessed portion for biasing the valve body in a valve closing direction.

4. A fuel injection device for an internal combustion engine comprising:

a common rail for storing high pressure fuel;

a fuel injection valve for injecting the high pressure fuel of the common rail into the engine;

a fuel return path operatively connected between the common rail and a low pressure side, and a depressurizing valve for opening and closing the fuel return path so that a part of the high pressure fuel flows from the common rail to the low pressure side when the fuel return path is opened by the depressurizing valve, wherein the depressurizing valve comprises;

a valve unit having a valve body for opening and closing the fuel return path; and a coil unit having a cylindrical electromagnetic coil for attracting the valve body in a valve opening direction when electric current is supplied to the electromagnetic coil, wherein the valve unit further comprises;

a valve housing of a cylindrical shape, which is firmly fixed to the common rail;

an armature integrally formed with the valve body;

a first space formed in the valve housing for accommodating the valve body and armature, and connected to the fuel return path;

a second space formed in the valve housing for accommodating the electromagnetic coil, such that the electromagnetic coil is rotatable with respect to the valve housing in a circumferential direction, the second space being formed coaxially with the first space;

a stator core arranged in an inner peripheral space of the electromagnetic coil and axially opposing to the armature;

a connecting member fluid tightly connected to the valve housing and to the stator core, for dividing, together with the stator core, an inside space of the valve housing into the first and second spaces; and a valve seat provided at one end of the first space and having a flow control port for operatively communicating the first space with a high pressure chamber of the common rail by an axial movement of the valve body, wherein the valve body and the armature are axially and movably held in the first space between the valve seat and the stator core; and wherein the coil unit is detachably assembled to the valve unit and further comprises;

a connector integrally formed with the electromagnetic coil;

a mounting member selectively screwed to the valve unit for detachably mounting the electromagnetic coil and the connector to the valve unit, wherein the coil unit is rotatable relative to the mounting member, so that a circumferential position of the connector can be adjusted when the mounting member is loosened from a firmly fixed position thereof;

a plate member, which is made of a magnetic material, arranged between the electromagnetic coil and the connector, and integrally molded with the connector;

a terminal integrally molded in the connector and electrically connected to the electromagnetic coil; and a through-hole formed in the plate member, through which the terminal passes, wherein the plate member is a disc-shaped member opposing to the valve housing and the stator core, and the mounting member is a retaining nut to be screwed to the valve housing, wherein the plate member is interposed between the valve housing and the retaining nut, and wherein the retaining nut has a cylindrical portion and a flanged portion inwardly extending from one longitudinal end of the cylindrical portion, a female screw portion is formed at an inner peripheral surface of the cylindrical portion so that the retaining nut is selectively screwed to the valve housing, and the flanged portion holds an outer peripheral portion of the plate member when the retaining nut is screwed to the valve housing, whereby when the retaining nut is screwed to the valve housing, the connector does not rotate with the retaining nut, so that a circumferential position of the connector and plate integrally molded therewith can be maintained.

5. A fuel injection device for an internal combustion engine comprising:

a common rail for storing high pressure fuel;

a fuel injection valve for injecting the high pressure fuel of the common rail into the engine;

a fuel return path operatively connected between the common rail and a low pressure side; and a depressurizing valve mounted to the common rail for opening and closing the fuel return path so that a part of the high pressure fuel flows from the common rail to the low pressure side when the fuel return path is opened by the depressurizing valve, wherein the depressurizing valve comprises;

a valve unit having a valve body for opening and closing the fuel return path; and a coil unit having a cylindrical electromagnetic coil for attracting the valve body in a valve opening direction when electric current is supplied to the electromagnetic coil, wherein the valve unit further comprises;

a valve housing of a cylindrical shape, which is firmly fixed to the common rail;

an armature integrally formed with the valve body;

a first space formed in the valve housing for accommodating the valve body and armature, and connected to the fuel return path;

a second space formed in the valve housing for accommodating the electromagnetic coil, such that the electromagnetic coil is rotatable with respect to the valve housing in a circumferential direction, the second space being formed coaxially with the first space;

a stator core arranged in an inner peripheral space of the electromagnetic coil and axially opposing to the armature;

a connecting member integrally formed with one of the valve housing and the stator core, for fluid tightly dividing, together with the stator core, an inside space of the valve housing into the first and second spaces, wherein the connecting member restricts magnetic flux flow between the stator core and the valve housing; and a valve seat provided at one end of the first space and having a flow control port for operatively communicating the first space with a high pressure chamber of the common rail by an axial movement of the valve body, wherein the valve body and the armature are axially and movably held in the first space between the valve seat and the stator core; and wherein the coil unit is detachably assembled to the valve unit and further comprises;

a connector integrally formed with the electromagnetic coil;

a plate member, which is made of a magnetic material, arranged between the electromagnetic coil and the connector, and integrally molded with the connector;

a terminal integrally molded in the connector and electrically connected to the electromagnetic coil;

a through-hole formed in the plate member, through which the terminal passes; and a mounting member selectively screwed to the valve unit for detachably mounting the electromagnetic coil and the connector to the valve unit, wherein the coil unit is rotatable relative to the mounting member, so that when the mounting member is loosened from a firmly fixed position thereof, the coil unit can be rotated with respect to the mounting member so that a circumferential position of the connector with respect to the mounting member can be adjusted, wherein the mounting member has a cylindrical portion and a flanged portion inwardly extending from one longitudinal end of the cylindrical portion, a female screw portion is formed at an inner peripheral surface of the cylindrical portion so that the mounting member is selectively screwed to the valve unit, and the flanged portion holds an outer peripheral portion of the plate member when the mounting member is screwed to the valve unit.

6. A fuel injection device according to claim 5, wherein a recessed portion is formed in the stator core and opening to the first space, and a spring is arranged in the recessed portion for biasing the valve body in a valve closing direction.

7. A fuel injection device for an internal combustion engine comprising:

a common rail for storing high pressure fuel;

a fuel injection valve for injecting the high pressure fuel of the common rail into the engine;

a fuel return path operatively connected between the common rail and a low pressure side; and a depressurizing valve mounted to the common rail for opening and closing the fuel return path so that a part of the high pressure fuel flows from the common rail to the low pressure side when the fuel return path is opened by the depressurizing valve, wherein the depressurizing valve comprises;

a valve unit having a valve body for opening and closing the fuel return path; and a coil unit having a cylindrical electromagnetic coil for attracting the valve body in a valve opening direction when electric current is supplied to the electromagnetic coil, wherein the valve unit further comprises;

a valve housing of a cylindrical shape, which is firmly fixed to the common rail;

an armature integrally formed with the valve body;

a first space formed in the valve housing for accommodating the valve body and armature, and connected to the fuel return path;

a second space formed in the valve housing for accommodating the electromagnetic coil, such that the electromagnetic coil is rotatable with respect to the valve housing in a circumferential direction, the second space being formed coaxially with the first space;

a stator core arranged in an inner peripheral space of the electromagnetic coil and axially opposing to the armature;

a connecting member integrally formed with one of the valve housing and the stator core, for fluid tightly dividing, together with the stator core, an inside space of the valve housing into the first and second spaces, wherein the connecting member restricts magnetic flux flow between the stator core and the valve housing; and a valve seat provided at one end of the first space and having a flow control port for operatively communicating the first space with a high pressure chamber of the common rail by an axial movement of the valve body, wherein the valve body and the armature are axially and movably held in the first space between the valve seat and the stator core; and wherein the coil unit is detachably assembled to the valve unit and further comprises;

a connector integrally formed with the electromagnetic coil;

a mounting member selectively screwed to the valve unit for detachably mounting the electromagnetic coil and the connector to the valve unit, wherein the coil unit is rotatable relative to the mounting member, so that a circumferential position of the connector can be adjusted when the mounting member is loosened from a firmly fixed position thereof;

a plate member, which is made of a magnetic material, arranged between the electromagnetic coil and the connector, and integrally molded with the connector;

a terminal integrally molded in the connector and electrically connected to the electromagnetic coil; and a through-hole formed in the plate member, through which the terminal passes, wherein the plate member is a disc-shaped member opposing to the valve housing and the stator core, and the mounting member is a retaining nut to be screwed to the valve housing, wherein the plate member is interposed between the valve housing and the retaining nut, and wherein the retaining nut has a cylindrical portion and a flanged portion inwardly extending from one longitudinal end of the cylindrical portion, a female screw portion is formed at an inner peripheral surface of the cylindrical portion so that the retaining nut is selectively screwed to the valve housing, and the flanged portion holds an outer peripheral portion of the plate member when the retaining nut is screwed to the valve housing, whereby when the retaining nut is screwed to the valve housing, the connector does not rotate with the retaining nut, so that a circumferential position of the connector and plate integrally molded therewith can be maintained.

8. A fuel injection device for an internal combustion engine comprising:

a common rail for storing high pressure fuel;

a fuel injection valve for injecting the high pressure fuel of the common rail into the engine;

a fuel return path operatively connected between the common rail and a low pressure side; and a depressurizing valve mounted to the common rail for opening and closing the fuel return path so that a part of the high pressure fuel flows from the common rail to the low pressure side when the fuel return path is opened by the depressurizing valve, wherein the depressurizing valve comprises;

a valve unit having a valve body for opening and closing the fuel return path; and a coil unit having a cylindrical electromagnetic coil for attracting the valve body in a valve opening direction when electric current is supplied to the electromagnetic coil, wherein the valve unit further comprises;

a valve housing of a cylindrical shape, which is firmly fixed to the common rail;

an armature integrally formed with the valve body;

a first space formed in the valve housing for accommodating the valve body and armature, and connected to the fuel return path;

a second space formed in the valve housing for accommodating the electromagnetic coil, such that the electromagnetic coil is rotatable with respect to the valve housing in a circumferential direction, the second space being formed coaxially with the first space;

a stator core arranged in an inner peripheral space of the electromagnetic coil and axially opposing to the armature;

a connecting member integrally formed with and arranged between the valve housing and the stator core, wherein the connecting member and the stator core divide an inside space of the valve housing into the first and second spaces, and wherein the connecting member restricts magnetic flux flow between the stator core and the valve housing; and a valve seat provided at one end of the first space and having a flow control port for operatively communicating the first space with a high pressure chamber of the common rail by an axial movement of the valve body, wherein the valve body and the armature are axially and movably held in the first space between the valve seat and the stator core; and wherein the coil unit is detachably assembled to the valve unit and further comprises;

a connector integrally formed with the electromagnetic coil;

a plate member, which is made of a magnetic material, arranged between the electromagnetic coil and the connector, and integrally molded with the connector;

a terminal integrally molded in the connector and electrically connected to the electromagnetic coil;

a through-hole formed in the plate member, through which the terminal passes; and a mounting member selectively screwed to the valve unit for detachably mounting the electromagnetic coil and the connector to the valve unit, wherein the coil unit is rotatable relative to the mounting member, so that when the mounting member is loosened from a firmly fixed position thereof, the coil unit can be rotated with respect to the mounting member so that an angular position of the connector with respect to the mounting member can be adjusted, wherein the mounting member has a cylindrical portion and a flanged portion inwardly extending from one longitudinal end of the cylindrical portion, a female screw portion is formed at an inner peripheral surface of the cylindrical portion so that the mounting member is selectively screwed to the valve unit, and the flanged portion holds an outer peripheral portion of the plate member when the mounting member is screwed to the valve unit.

9. A fuel injection device according to claim 8, wherein a recessed portion is formed in the stator core and opening to the first space, and a spring is arranged in the recessed portion for biasing the valve body in a valve closing direction.

10. A fuel injection device for an internal combustion engine comprising:

a common rail for storing high pressure fuel;

a fuel injection valve for injecting the high pressure fuel of the common rail into the engine;

a fuel return path operatively connected between the common rail and a low pressure side; and a depressurizing valve mounted to the common rail for opening and closing the fuel return path so that a part of the high pressure fuel flows from the common rail to the low pressure side when the fuel return path is opened by the depressurizing valve, wherein the depressurizing valve comprises;

a valve unit having a valve body for opening and closing the fuel return path; and a coil unit having a cylindrical electromagnetic coil for attracting the valve body in a valve opening direction when electric current is supplied to the electromagnetic coil, wherein the valve unit further comprises;

a valve housing of a cylindrical shape, which is firmly fixed to the common rail;

an armature integrally formed with the valve body;

a first space formed in the valve housing for accommodating the valve body and armature, and connected to the fuel return path;

a second space formed in the valve housing for accommodating the electromagnetic coil, such that the electromagnetic coil is rotatable with respect to the valve housing in a circumferential direction, the second space being formed coaxially with the first space;

a stator core arranged in an inner peripheral space of the electromagnetic coil and axially opposing to the armature;

a connecting member integrally formed with and arranged between the valve housing and the stator core, wherein the connecting member and the stator core divide an inside space of the valve housing into the first and second spaces, and wherein the connecting member restricts magnetic flux flow between the stator core and the valve housing; and a valve seat provided at one end of the first space and having a flow control port for operatively communicating the first space with a high pressure chamber of the common rail by an axial movement of the valve body, wherein the valve body and the armature are axially and movably held in the first space between the valve seat and the stator core;

wherein the coil unit is detachably assembled to the valve unit and further comprises;

a connector integrally formed with the electromagnetic coil;

a mounting member selectively screwed to the valve unit for detachably mounting the electromagnetic coil and the connector to the valve unit, wherein the coil unit is rotatable relative to the mounting member, so that a circumferential position of the connector can be adjusted when the mounting member is loosened from a firmly fixed position thereof;

a plate member, which is made of a magnetic material, arranged between the electromagnetic coil and the connector, and integrally molded with the connector;

a terminal integrally molded in the connector and electrically connected to the electromagnetic coil; and a through-hole formed in the plate member, through which the terminal passes, wherein the plate member is a disc-shaped member opposing to the valve housing and the stator core, and the mounting member is a retaining nut to be screwed to the valve housing, wherein the plate member is interposed between the valve housing and the retaining nut, and wherein the retaining nut has a cylindrical portion and a flanged portion inwardly extending from one longitudinal end of the cylindrical portion, a female screw portion is formed at an inner peripheral surface of the cylindrical portion so that the retaining nut is selectively screwed to the valve housing, and the flanged portion holds an outer peripheral portion of the plate member when the retaining nut is screwed to the valve housing, whereby when the retaining nut is screwed to the valve housing, the connector does not rotate with the retaining nut, so that a circumferential position of the connector and plate integrally molded therewith can be maintained.

* * * * *